United States Patent [19]

Wassen

[11] 3,950,978

[45] Apr. 20, 1976

[54] STRETCH-FORMING OF LONG TUBES

[75] Inventor: Johann Wassen, Brackwede, Germany

[73] Assignee: Mannesmannrohren-Werke AG, Dusseldorf, Germany

[22] Filed: Jan. 7, 1975

[21] Appl. No.: 539,231

[30] Foreign Application Priority Data

Jan. 9, 1974 Germany ..... 2401345

[52] U.S. Cl. ..... 72/283; 72/285

[51] Int. Cl.[2] ..... B21C 1/24

[58] Field of Search ..... 72/285, 283, 302, 370, 72/378

[56] References Cited

UNITED STATES PATENTS

| | | | |
|---|---|---|---|
| 3,572,080 | 3/1971 | Alexoff | 72/367 |
| 3,654,794 | 4/1972 | Brak et al. | 72/285 |
| 3,672,200 | 6/1972 | Ogasawara | 72/285 |
| 3,672,201 | 6/1972 | Hinshaw | 72/285 |

FOREIGN PATENTS OR APPLICATIONS

| | | | |
|---|---|---|---|
| 1,079,932 | 12/1954 | France | 72/370 |
| 322,558 | 10/1902 | France | 72/283 |

*Primary Examiner*—Milton S. Mehr
*Attorney, Agent, or Firm*—Ralf H. Siegemund

[57] ABSTRACT

Tubular blanks are stretch-formed by moving a mandrel into such a blank while holding a die which receives the blank and until mandrel and die are radially aligned. Subsequently, mandrel and die are moved axially to complete the drawing.

8 Claims, 1 Drawing Figure

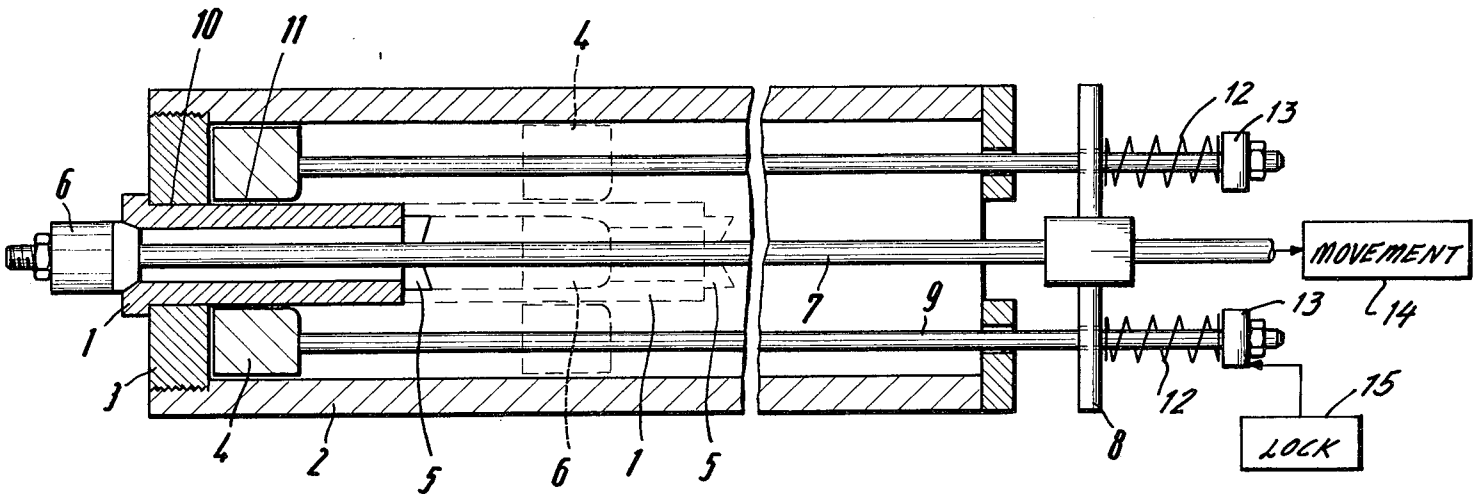
MOVEMENT
LOCK
14
15
13
13
12
12
8
9
7
5
1
4
6
5
2
11
4
10
3
1
6

STRETCH-FORMING OF LONG TUBES

BACKGROUND OF THE INVENTION

The present invention relates to stretch-forming of tubes, particularly of long tubes with accurately defined inner and outer diameters, i.e. these diameters are to be within predetermined tolerances upon completion of the stretch-forming process and the surfaces should have a rather fine finish even without a separate finishing step.

It is known to stretch-form short tube sections by means of a sleeve-like drawing die of accurate dimensions. This way, one obtains inner and outer dimensions within very low tolerances, and the inner surface is sufficiently smooth so that additional finishing may not be required. Furthermore, the texture of the material is improved by the stretch-forming operation. The known methods fail, however, when applied to longer tubes. This is particularly due to the requirement for a drawing die having the length of the completed tube and having the required surface finish. Accurate deep drilling is not possible for lengths exceeding, say 15 feet.

DESCRIPTION OF THE INVENTION

It is an object of the present invention to provide for a new and improved method and apparatus for stretch-forming long tubes having the same surface finish as known methods establish for short tube sections.

In accordance with the preferred embodiment of the invention, it is suggested to use a relatively short drawing die to be held in position during an initial phase of drawing as a drawing mandrel is moved into a tubular blank and until having been at least approximately aligned radially with the die. Subsequently, the die and the mandrel are moved in unison to complete the stretch-forming as drawing the blank axially. During all this time, the blank is held on one side, and drawing proceeds by the moving mandrel while the die remains stationary at first, and later by moving the die and the mandrel away from the point of holding.

One will preferably link the mandrel and the die so that at first they can move relative to each other followed by direct coupling, so that they move together for completing the drawing. The blank is preferably held by a plate with an opening into which the blank is inserted and having a diameter equal to the diameter of the tube to be drawn. The die has a drawing opening of like diameter and is juxtaposed to that plate in the initial phase.

It can thus be seen that by operation of the invention, tubes of larger length can be drawn, using a relatively short drawing die which simulates a long one due to concurring motion with the drawing mandrel.

DESCRIPTION OF THE DRAWINGS

While the specification concludes with claims particularly pointing out ad distinctly claiming the subject matter which is regarded as the invention, it is believed that the invention, the objects and features of the invention and further objects, features and advantages thereof will be better understood from the following description taken in connection with the accompanying drawings in which:

The FIGURE shows a cross-section through the preferred embodiment of the invention.

Proceeding now to the detailed description of the drawings, the FIGURE shows a tubular blank 1 inserted in an opening 10 of an annular holder 3 which is secured in a drawing frame or stand 2. The blank may be provided with a rear end flange for abutment with the rear surface adjacent to the annular opening 10 of holder 3. The diameter of that opening 10 corresponds accurately to the final diameter of the tube to be made and, of course, should not be smaller than the diameter of the tubular blank, as inserted.

A sleeve-like die 4 of short axial dimensions rests in abutment against the front surface of holder 3, but is not secured thereto. Rather, die 4 is held in position by rods 9. The rods are locked in position by operation of a lock 15 shown schematically only. This way die 4 is held in the illustration position until its displacement is actually desired. The blank traverses likewise die 4. The die opening 11 has a diameter which corresponds also to the outer diameter of the tube to be made, whereby particular the diameters of openings 10 and 11 should be equal, at least within the chosen range of tolerances for the tube to be made.

Reference numeral 6 refers to a drawing mandrel held by and secured to a mandrel rod 7, which in turn is secured to a drawing plate 8. The mandrel has a tapered front end and is of larger diameter than the inner diameter of the tubular blank to obtain drawing operation upon inserting the mandrel into the blank and by movement therethrough. The blank and here particularly the not yet drawn portion is held by rolls 5 to avoid any lateral displacement. The rolls move with the mandrel rod during the drawing process.

The rods 9 traverse (with play) openings in plate 8, and biasing springs 12 are interposed between the plate 8 and cams 13; these cams are respectively affixed to the rods 9. The springs may be expanded, so as to urge the die 4 into abutment with holder 3.

The mandrel 6 is shown in the starting position, just engaging one end of the blank 1. Mandrel and mandrel rod 7 are moved by a suitable drive mechanism 14 (e.g. hydraulically) in a manner known per se for drawing and for mandrel displacement generally.

As the stretch-forming operation begins, the mandrel rod 7 with mandrel 6 is moved, in the drawing to the right, so that the drawing process begins. Holder 3 acts, in fact, also as a die in the beginning of the stretch forming process, and die 4 takes over subsequently. However, die 4 is held in position until plate 8 engages the lock 15 to obtain unlocking. The lock may be constructed for retraction upon engagement by plate 8. Alternatively, plate 8 may operate a switch, so that, for example, a solenoid is energized to retract the lock.

Following unlocking plate 8 abuts the cams 13, not directly though, as the springs 14 are interposed, but their expansion has been reduced to zero, so that the abutting turns of the springs 14 together act now as rigid coupler or transmission sleeves between cams 13 and plate 8.

In this disposition, mandrel 6 is aligned radially with die 4 as shown in dotted lines. As the mandrel 6 continues its movement to the right, die 4 is carried along and remains in the radially aligned disposition with the mandrel throughout the subsequent stretch-forming by drawing in the manner indicated. Drawing continues in this relative disposition, with mandrel 6 and die 4 moving in unison, but tube-blank 1 is held in holder 3. This way, an elongated die is simulated.

In order to avoid lateral displacement of the die, it must be accurately held and guided in frame or stand 2. The blank is guided by rolls 5 during the drawing process.

The invention is not limited to the embodiments described above, but all changes and modifications thereof not constituting departures from the spirit and scope of the invention are intended to be included.

I claim:

1. Apparatus for stretch-forming of a tube from a tubular blank under utilization of a drawing die and a drawing mandrel, and including means for holding one end of the tubular blank throughout the stretch-forming, the improvement comprising:

the drawing die being relatively short and of tubular configuration with a cylindrical interior surface, said die being disposed for movement along the axis of the tube;

the drawing mandrel disposed for movement relative to the die and having a cylindrical working surface;

first means for holding the die adjacent said one end during an initial phase of drawing as the mandrel is inserted into the blank; and second means for moving the mandrel into the blank at said one end as the first means holds the die until the mandrel is at least approximately radially aligned with the die, wherein said cylindrical surfaces face each other and for moving the mandrel and the die in unison so as to complete stretch-forming the tubular blank.

2. Apparatus as in claim 1 and including a stand for guiding the die.

3. Apparatus as in claim 1 said means for holding and including a holder plate in which the blank is inserted and held from one side, the die having abutting position to that plate during said initial phase.

4. Apparatus as in claim 3, the holding plate and the die having openings of similar diameters corresponding to the outer diameter of the tube to be drawn.

5. Apparatus as in claim 1, the second means including a linkage between the mandrel and the die to permit relative movement between them during the initial phase, but coupling them together for synchronous movements following establishing of radial alignment between them.

6. Apparatus as in claim 1, wherein the cylindrical surfaces of the die and of the mandrel have at least approximately similar axial length, considerably shorter axially than the length of the tube to be made.

7. Apparatus as in claim 1, the first means including means for locking the die in position during said initial phase.

8. Apparatus as in claim 1, including guide rollers for holding the blank ahead of drawing.

* * * * *